US006662394B2

(12) United States Patent
Balint

(10) Patent No.: US 6,662,394 B2
(45) Date of Patent: Dec. 16, 2003

(54) AUTOMATIC CLEANERS FOR CLEANING SWIMMING POOLS

(75) Inventor: Zoltan Balint, Niddric (AU)

(73) Assignee: Zoltans Pool Products Pty Ltd., Niddric (AU)

( * ) Notice: Subject to any disclaimer, the term of this patent is extended or adjusted under 35 U.S.C. 154(b) by 45 days.

(21) Appl. No.: 09/854,953

(22) Filed: May 14, 2001

(65) Prior Publication Data

US 2002/0166185 A1 Nov. 14, 2002

(30) Foreign Application Priority Data

Mar. 7, 2001 (AU) ..... PR3584

(51) Int. Cl.[7] ..... E04H 4/16
(52) U.S. Cl. ..... 15/1.7; 15/404
(58) Field of Search ..... 15/1.7, 404; 251/356; 137/119.01, 119.06

(56) References Cited

U.S. PATENT DOCUMENTS

| | | | | |
|---|---|---|---|---|
| 4,023,227 A | | 5/1977 | Chauvier | |
| 4,152,802 A | | 5/1979 | Chauvier | |
| 4,156,948 A | | 6/1979 | Chauvier et al. | |
| 4,193,156 A | | 3/1980 | Chauvier | |
| 4,208,752 A | * | 6/1980 | Hofmann | 15/1.7 |
| 5,706,540 A | * | 1/1998 | Niewiarowski | 137/561 R |
| 5,970,557 A | * | 10/1999 | Supra | 15/1.7 |
| 6,112,354 A | * | 9/2000 | Stoltz et al. | 15/1.7 |
| 6,298,513 B1 | * | 10/2001 | Rief et al. | 15/1.7 |
| D460,805 S | * | 7/2002 | Balint | D23/249 |

FOREIGN PATENT DOCUMENTS

| | | | | |
|---|---|---|---|---|
| EP | 543387 A2 | * | 5/1993 | E04H/4/16 |
| EP | 559477 A1 | * | 9/1993 | E04H/4/16 |

OTHER PUBLICATIONS

Exerpt from *Kreepy Krauly Owner's Manual*; Website Advertisement of Product at www.pentairpool.com, initial date unknown, two pages.

* cited by examiner

*Primary Examiner*—Robert J. Warden, Sr.
*Assistant Examiner*—Shay L Balsis
(74) *Attorney, Agent, or Firm*—Greer, Burns & Crain, Ltd.

(57) ABSTRACT

An automatic pool cleaner of the type having an elongated body (11) with an inlet, a flexible seal (32) mounted on an end of the elongated body to bear against the surface of the wall or floor of the pool, a flip-flop valve (25) positioned adjacent the inlet (21) of the elongated body (11) and capable of moving back and forth between two extreme positions for controlling the flow of water through the elongated body and in so doing producing a "water hammer effect" which acts on the automatic pool cleaner to propel it across the surface and wherein the flip-flop valve includes a substantially wedge shaped hammer (25) formed by two spaced substantially triangular sides interconnected by a central body narrower than the sides and a continuous end surface (61) connecting respective ends of the substantially triangular side pieces such that the hammer has continuous sides and cavities between the sides due to the central body being narrower than the sides, the continuous end surface (61) having indentations (65) to be engaged by flow of water around the hammer (25) and into the inlet (21) of the elongated body (11) to aide the flip-flop action.

17 Claims, 2 Drawing Sheets

AUTOMATIC CLEANERS FOR CLEANING SWIMMING POOLS

FIELD OF THE INVENTION

This invention relates to automatic pool cleaners of the type adapted to be connected to a flexible hose, which is connected to the inlet of a pump circulating water through the pool. One such cleaner is marketed throughout Australia and other countries under the trade mark "Zoltans Automatic Pool Cleaner". Another version is sold under the trademark "Kreepy Krauly". One version of the Kreepy Krauly cleaner is described in the expired Australian Patent Specification No. 505209.

BACKGROUND OF THE INVENTION

Such automatic pool cleaners can comprise a body having an inlet, a flexible seal mounted on the body to bear against a surface of a wall or floor of a pool, a flip-flop valve capable of moving back and forth between two extreme positions for controlling water flowing through a body and in doing so produce a water hammer effect which acts on the automatic cleaner to propel it across the surface. An elongated member connects the body to the inlet end of a flexible hose. The elongated member has two passages formed by two parallel tubes through which the water flows alternately.

It has been found that the flip-flop valve performance is substantially and unexpectedly affected by small changes in structure and thereby substantially affects the efficiently of the automatic pool cleaner. It has been found that the efficiency of the automatic pool cleaner can be substantially improved if the hammer valve member forming the critical part of the flip-flop valve is altered.

It is therefore an object of the invention to devise an improved automatic pool cleaner, which may be effective with a less powerful suction means than is presently possible.

It is also an object of the invention to provide an improved automatic pool cleaner which overcomes or ameliorates one or more disadvantages of known automatic pool cleaners.

BRIEF SUMMARY OF THE INVENTION

Thus, according to the present invention, there is provided an automatic pool cleaner of the type having an elongated body with an inlet, a flexible seal mounted on an end of the elongated body to bear against the surface of the wall or floor of the pool, a flip-flop valve positioned adjacent to the inlet of the elongated body and capable of moving back and forth between two extreme positions for controlling the flow of water through the elongated body and in so doing producing a "water hammer effect" which acts on the automatic pool cleaner to propel it across the surface and wherein the flip-flop valve includes a substantially wedge-shaped hammer valve member formed by two spaced, substantially triangular sides interconnected by a central body narrower than the sides and an end surface connecting respective ends of the substantially triangular sides such that the hammer valve member has continuous sides and cavities between the sides due to a central body being narrower than the triangular sides, the end surface having indentations to be engaged by flow of water around the hammer valve member and into the inlet of the elongated body to aid the flip-flop action.

The indentations can be of the order of 20 to 30% of the end surface allowing ready flow around the hammer valve member while providing sufficient reaction of the water flow to aid the flip-flop action. Preferably the end surface is curved with the radius of curvature at least equal to the length of the wedge-shaped hammer.

In one form, the indentations can be spaced, circular indentations extending in two lines on either side of a longitudinal center of the end surface. The indentations can be substantially hemispherical such that their depth is of the order of about their radius.

The substantially wedge-shaped hammer valve member can be less than 80 grams and preferably less than 75 grains.

Using a light hammer valve member provides a faster flip-flop action and thereby a greater suction seal. Further, the lighter the hammer valve member the smoother the flip-flop action as there is less vibration which results in less lateral knocking motion that could break the suction seal of the automatic pool cleaner from the pool. This is particularly advantageous in cleaning higher up the walls of the pool. The spaced, circular indentations provide unexpectedly substantial initiation improvement and increased suction seal through providing flow friction points and/or turbulence effect and provide continuing aid in the flip-flop action of the hammer valve member. It avoids the known problem of earlier cleaners using heavier flip-flop valves, such as greater than 90 grams, to make use of the weight to initiate the flip-flop action when suction has begun. Such systems were particularly ineffective in cleaning walls of pools and often had the suction seal broken by a violent "water hammer effect". Further such systems require a large pool vacuum system to cope with the weight and to compensate for the suction seal breakages.

BRIEF DESCRIPTION OF THE DRAWINGS

In order to explain the invention more clearly, an embodiment will be described by way of illustration only with reference to the drawings wherein.

DESCRIPTION OF PREFERRED EMBODIMENT

Figures 1, 2:
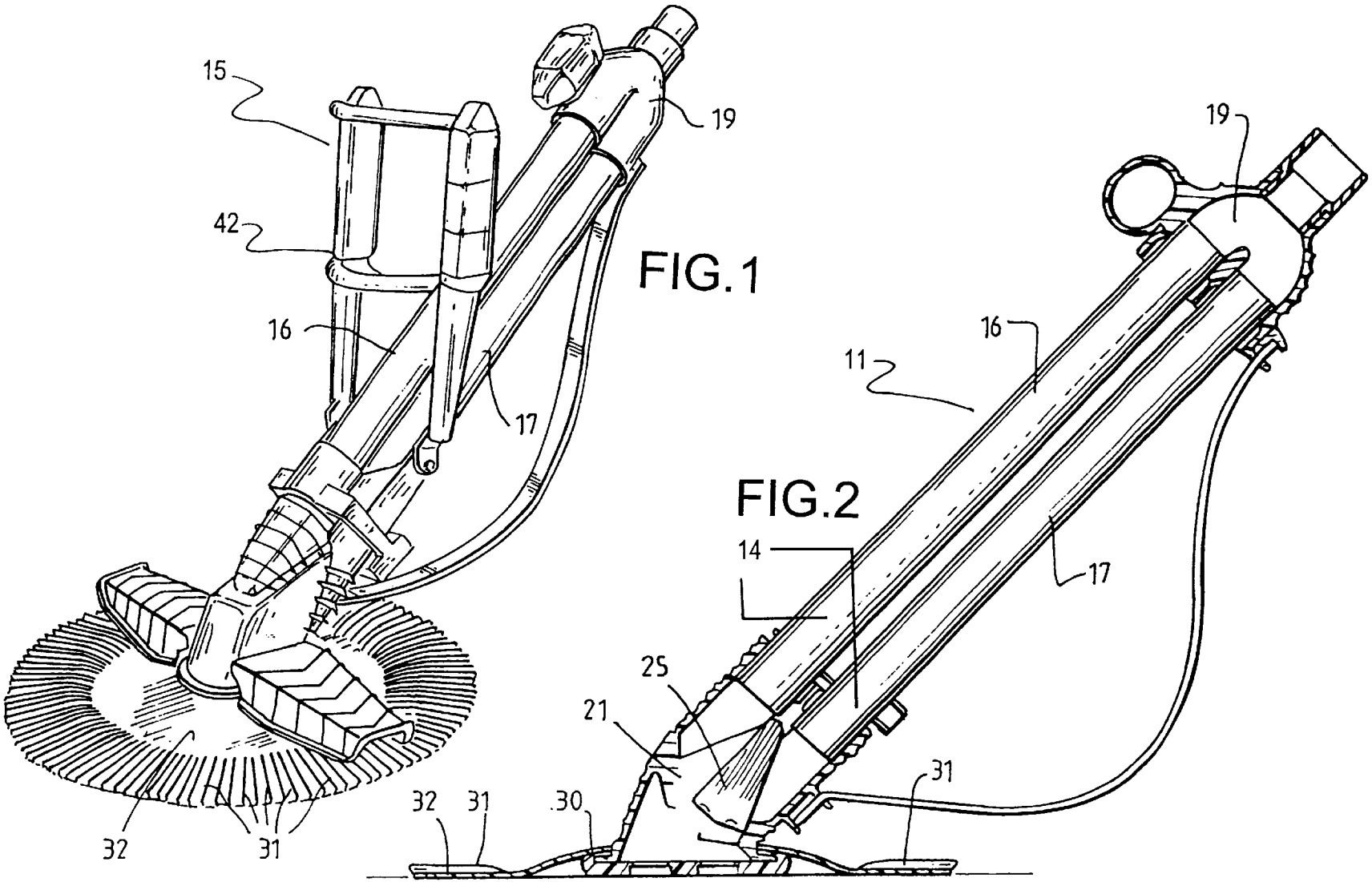
FIG. 1 is a perspective view of a known automatic pool cleaner suitable for use with the present hammer valve member.
FIG. 2 is a cross sectional view of the automatic pool cleaner of FIG. 1.

Referring to FIGS. 1 and 2 of the drawings, there is shown an elongated body 11 of an automatic pool cleaner 15 having two generally parallel tubes 14 defining coextending tubular chambers 16, 17 meeting at a top U-shaped connector 19 that feeds to a suction pump (not shown). At the lower end of the elongated body lithe two coextending tubular chambers 16, 17 have angled inlet openings from a valve chamber 21 in which a wedge-shaped hammer valve member 25 is housed so that it can move back and forth with a flip-flop action about a longitudinal axis extending between the coextension of the tubular chambers 16, 17. The flip-flop action is also wound a lateral pivot end at the narrow pivot end 56 (FIG. 3) of the wedge-shaped hammer valve member 25 and is able to flip-flop between positions in which the hammer valve member alternately bears against and closes the inlet end of first passage or fluid flow path formed by first coextending tubular chamber 16 to a position in which the hammer valve member 25 bears against the inlet end and closes a second passage or fluid flow path formed by second coextending tubular chamber 17. The movement of the hammer valve member 25 from one position to the other produces a "water hammer effect" which acts on the cleaner to propel it across the surface to be cleaned.

The upper ends of tubes 14 are connected to a chamber 17, the upper end of which is pivotally connected to the inlet end of a flexible hose (not shown) by means of a coupling. The base of the cleaner body is provided with wings 30, 31 and pleated flexible seal 32, which bears on the surface to be cleaned (not shown). It is also provided with one or more inlets while the valve chamber 21 may be provided with a baffle (not seal 32, which bears on the surface to be cleaned (not shown). It is also provided shown). A float assembly 42 is pivotally mounted on the body of the cleaner.

Figure 3:
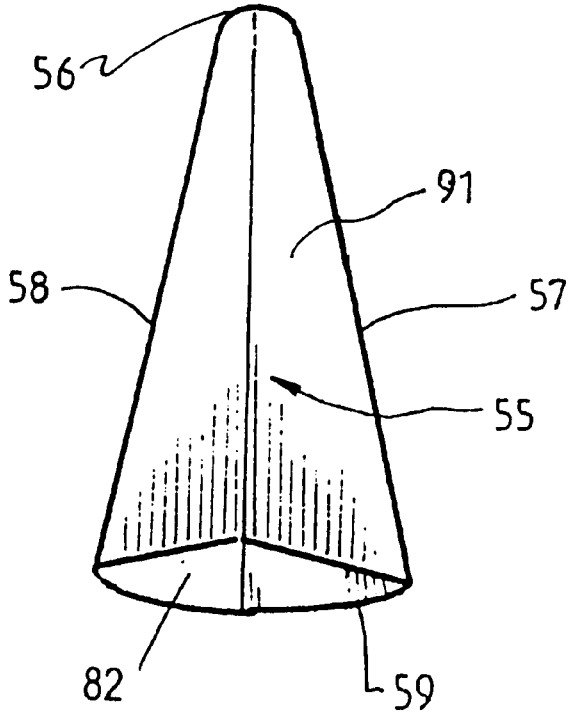
FIG. 3 is a side elevation of a hammer valve member which operates in a flip-flop manner in accordance with the invention for use in the automatic pool cleaner of FIG. 1.
Figure 4:
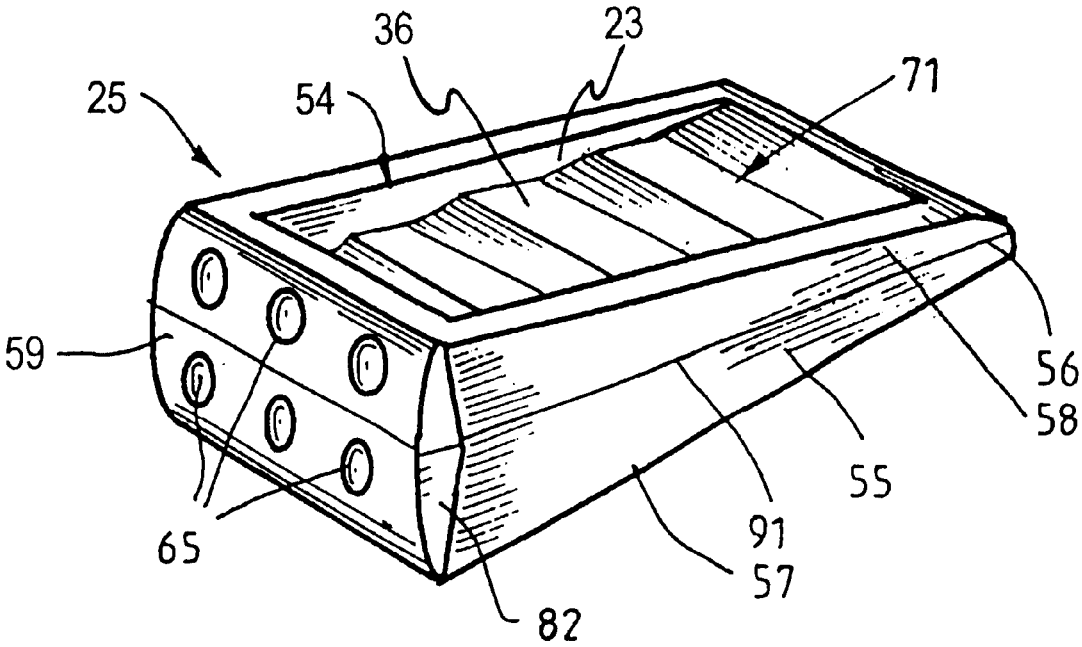
FIG. 4 is a perspective view of the hammer valve member of FIG 3.

In accordance with the invention, the hammer valve member 25 has the construction shown in FIGS. 3 and 4 to provide a more efficient automatic pool cleaner. The hammer valve member 25 comprises a substantially wedge-shape formed of two spaced substantially triangular sides 54, 55 interconnected by a central body 71 narrower than the sides 54, 55 and extending normal to the planar extensions of the triangular sides 54, 55. The two spaced substantially triangular sides 54, 55 each has diverging straight sides 57, 58 beginning at a narrow pivot end 56 and ending at a preferably curved end surface 59 such that the substantially triangular sides 54, 55 each form a sector of a circle.

The end surface 59 connecting the two spaced, substantially triangular sides 54, 55 on a rear surface receives the interconnecting central body 71 extending normal to the spaced, substantially triangular sides 54, 55. This central body 71 extends between the sides 54, 55 to form the substantially wedge-shape An outer end of the two spaced substantially triangular sides 54, 55 further includes a tapered surface 82 extending with linear front edges about 1 to 2 millimeters out from the outer triangular sides 54, 55 and extending to the end surface 59.

The interconnecting central body 71 extends substantially in a single plane with outer surfaces 36 (only one shown) extending between the respective spaced substantially triangular sides 54, 55. The outer surfaces 36 have a continuous, substantially triangular sine wave formation with a wavelength on the order of 18 millimeters and an amplitude of about 3 millimeters. The hammer valve member 25 thus defines cavities 23 between the sides 54, 55 due to the central body 71 being narrower than the sides.

The end surface 59 of the hammer valve member 25 has indentations 65 in order to allow flow of water around the end surface 59 of the hammer valve member 25 and into the inlet end of the first passage or fluid flow path formed by the first coextending tubular chamber 16 and the hammer valve member 25 to allow flow into inlet end of the second passage or fluid flow path formed by the second coextending tubular chamber 17. This results in a pulsing to provide the "water hammer effect". The end surface 59 preferably has six spaced indentations 65 in two lines of three on either side of the central longitudinal line of symmetry. The indentations are about 9 to 10 millimeters in diameter with a depth in the order of 5 to 10 millimeters.

The angle of divergence of the diverging straight sides 57, 58 is about 25° and the length of the two spaced substantially triangular sides 54, 55 is of the order of 90 millimeters with the spacing being about 35 millimeters. This results in the spacing between the respective end surface 59 of the two spaced substantially triangular sides 54, 55 being about 38 millimeters. Further, the footprint provided by the curved end surface 59 is rectangular with dimensions of about 38 millimeters by 50 millimeters.

The hammer valve member 25 is made from mouldable synthetic materials that are suitable for enduring the harsh conditions within the automatic pool cleaner and harsh chemicals such as chlorine. It also has a weight of the order of about 70 grams. To achieve the moulded configuration the hammer valve member 25 is made in two exactly similar moulds each forming parts of each side wall 54, 55, part of the central body 71 therebetween having a substantially triangular sine wave surface, and part of the end surface 59. Two of the partial units formed by the moulds can be joined back-to-back along a central mould line 91.

The above is a description of a preferred embodiment of the present invention. Various changes and modifications can be made without inventiveness by a person skilled in the art and without departing from the spirit and scope of the present invention and such are included within the scope of the invention as defined by the following claims.

What is claimed is:

1. An automatic pool cleaner of the type having an elongated body with an inlet, a flexible seal mounted on an end of the elongated body to bear against a surface of a wall or floor of a pool, a flip-flop valve positioned adjacent the inlet of the elongated body and capable of moving back and forth between two extreme positions for controlling water flow through the elongated body and in so doing producing a "water hammer effect" which acts on the automatic pool cleaner to propel it the surface and wherein the flip-flop valve includes a substantially wedge-shaped hammer valve member formed by two spaced, substantially triangular sides interconnected by a central body narrower than the triangular sides and an end surface connecting respective ends of the substantially triangular sides such that the hammer valve member has continuous sides and cavities between the triangular sides due to the central body being narrower than the triangular sides, the end surface having indentations to be engaged by flow of water around the hammer valve member and into the inlet of the elongated body to aid flip-flop action achieved by the hammer valve member upon exposure to the water flow, said indentations are substantially hemispherical such that their depth is of the order of about their radius.

2. An automatic pool cleaner according to claim 1 wherein the indentations are of the order of 20 to 30% of the end surface allowing ready flow around the hammer valve member while providing sufficient reaction of the flow to aid the flip-flop action.

3. An automatic pool cleaner according to claim 1 wherein the end surface is curved with a radius of curvature at least equal to the length of the wedge-shaped hammer valve member.

4. An automatic pool cleaner according to claim 1 wherein the indentations can be spaced circular indentations extending in two lines on either side of a longitudinal center of the end surface.

5. A flip-flop valve able to be used in an automatic pool cleaner of the type having an elongated body with an inlet, a flexible seal mounted on an end of the elongated body to bear against a surface of a wall or floor of a pool, wherein the flip-flop valve can be positioned adjacent the inlet of the elongated body and move back and forth between two extreme positions for controlling water flow through the elongated body of the automatic pool cleaner and in so doing producing a "water hammer effect" which acts on the automatic pool cleaner to propel it across the surface and wherein the flip-flop valve includes a substantially wedge-shaped hammer valve member formed by two spaced substantially triangular sides interconnected by a central body narrower than the triangular sides and an end surface connecting respective ends of the substantially triangular sides such that the hammer valve member has continuous sides and cavities between the triangular sides due to the central body being narrower than the triangular sides, the end surface having indentations to be engaged by flow of water around the hammer valve member and into the inlet of the elongated body to aid flip-flop action achieved by the hammer valve member upon exposure to the water flow, wherein the indentations are about 9 to 10 millimeters in diameter with a depth in the order of 5 to 10 millimeters.

6. A flip-flop valve according to claim 5 wherein the indentations can be of the order of about 20% to 30% of the end surface allowing ready flow of water around the hammer valve member while facilitating the flip-flop action upon exposure to the water flow.

7. A flip-flop valve according to claim 5 wherein the end surface is curved with a radius of curvature at least equal to the length of the wedge-shaped hammer valve member.

8. A flip-flop valve according to claim 5 wherein the indentations are spaced circular indentations extending in two lines on either side of the a longitudinal center of the end surface and wherein the indentations are substantially hemispherical such that their depth is of the order of about their radius.

9. A flip-flop valve according to claim 5 further including a tapered surface extending from a wider or base end of each triangular side about 1 to 2 millimeters from the of the triangular sides and extending to the end surface.

10. A flip-flop valve according to claim 5 wherein the interconnecting central body extends substantially in a single plane and has outer surfaces extending between respective spaced substantially triangular sides.

11. A flip-flop valve according to claim 10 wherein the outer surfaces have a continuous substantially triangular sine wave formation with as wavelength of the order of 18 millimeters and amplitude of about 3 millimeters.

12. A flip-flop valve according to claim wherein the hammer valve member has cavities between the triangular sides due to the central body being narrower than the triangular sides.

13. A flip-flop valve according to claim 5 wherein the end surface of the hammer valve member has indentations in order to allow flow of water around the end surface of the hammer valve member and into inlet end of first passage or fluid flow pat formed by first coextending tubular chambers and flip-flop hammer valve member to allow flow into inlet end of second passage or fluid flow path formed by second coextending tubular chambers resulting in a pulsing to provide the "water hammer effect".

14. A flip-flop valve according to claim 5 wherein the end surface has six spaced indentations in two lines of three on either side of a central longitudinal line of symmetry.

15. A flip-flop valve according to claim 5 wherein the hammer is made from mouldable, synthetic material.

16. A flip-flop valve according to claim 5 having a weight of the order of about 70 grams.

17. An automatic pool cleaner of the type having an elongated body with an inlet, a flexible seal mounted on an end of the elongated body to bear against a surface of a wall or floor of a pool, a flip-flop valve positioned adjacent the inlet the elongated body and capable of moving back and forth between two extreme for controlling water flow through the elongated body and in so doing producing a "water hammer effect" which acts on the automatic pool cleaner to propel it across the surface and wherein the flip-flop valve includes a substantially wedge-shaped hammer valve member formed by two spaced, substantially triangular sides interconnected by a central body narrower than the triangular sides and an end surface connecting respective ends of the substantially triangular sides such that the hammer valve member has continuous sides and cavities between the triangular sides due to the central body being narrower than the triangular sides, the end surface having indentations to be engaged by flow of water around the hammer valve member and into the inlet of the elongated body to aid flip-flop action achieved by the hammer valve member upon exposure to the water flow, said indentations are substantially hemispherical.

* * * * *